United States Patent [19]

Ross

[11] Patent Number: 4,457,205

[45] Date of Patent: Jul. 3, 1984

[54] MULTIPLE FIBER ARMATURES FOR ELECTROMAGNETIC LAUNCHERS

[75] Inventor: David P. Ross, Center Township, Beaver County, Pa.

[73] Assignee: Westinghouse Electric Corp., Pittsburgh, Pa.

[21] Appl. No.: 328,887

[22] Filed: Dec. 9, 1981

[51] Int. Cl.[3] ..... F41F 1/02

[52] U.S. Cl. ..... 89/8; 124/3; 376/108

[58] Field of Search ..... 376/108; 89/8; 124/3

[56] References Cited

U.S. PATENT DOCUMENTS 4,277,708 7/1981 McNab et al. ..... 310/228

OTHER PUBLICATIONS

"Moving Contacts in Macro-Particle Accelerators", In: High Power High Energy Pulse Production and Application, (Australian National University Press, Canberra 1978), pp. 216-230, Marshall.

New England Electric Wire Corp., Catalog p. 13.

Kerrigan Lewis Manufacturing Co., Catalog pp. 21-23.

*Primary Examiner*—Sal Cangialosi

*Attorney, Agent, or Firm*—R. P. Lenart

[57] ABSTRACT

An armature for electromagnetic launchers is provided with multiple conductive fibers which form a multi-contact interface with the launcher rails. The fibers are attached to an insulating armature support and can extend across the launcher bore or be attached to contact faces of a trailing conductive chevron. Transposition of the fibers reduces electrical skin effect within the armature.

14 Claims, 5 Drawing Figures

MULTIPLE FIBER ARMATURES FOR ELECTROMAGNETIC LAUNCHERS

GOVERNMENT CONTRACT

The Government has rights in this invention pursuant to Contract No. N00014-79-C-0110 awarded by the Department of the Navy.

BACKGROUND AND SUMMARY OF THE INVENTION

This invention relates to armatures for conducting very large currents between parallel rails of electromagnetic launchers and more particularly to such armatures employing multiple conducting fibers to conduct current between the launcher rails.

In the electromagnetic propulsion of projectiles, a very large dc current, on the order of several hundred thousand amperes, is injected into the breech end of a pair of parallel rails. A projectile which is in sliding contact with the rails is driven toward the muzzle end of the rails where it is ejected at a very high velocity, on the order of several kilometers per second, by the electromagnetic forces generated by the very large current. In many of these projectile launching assemblies, the projectile is provided with an armature which conducts the current between the rails. Originally, the projectile itself was a solid conducting body which served as the armature. Subsequent projectiles included a separate armature, made up of "leaves" of conductive material affixed to the rear of the projectile. The leaves were stacked in the direction of movement of the projectile with each leaf bridging the gap between the rails. The purpose of the laminated armature was to provide better sliding electrical contact between the armature and the rails. Electrical contact was enhanced by making the laminations of resilient, conductive sheets bent about an axis transverse to the direction of armature movement in a chevron configuration so that when the armature was placed between the rails, the ends of each leaf trailed toward the breech end of the launcher and were biased against the adjacent rails. In some configurations the center portion of each lamination was perpendicular to the rails with just the ends trailing rearward.

Experience has shown that with these prior art armatures, the current is concentrated in the corners of the armature adjacent the breech end of the rails. The higher current density at these points causes them to become hot spots. While the multiple leaf configuration reduces this current concentration somewhat, true uniform current distribution among multiple leaves cannot be achieved (at any armature velocity) no matter how thin the individual leaves are made if they are all identical. In fact, the discovery that practically all of the current was carried by the rearmost leaf, led one researcher to discard all of the chevron shaped leaves except one. This single leaf was then laminated from sheets oriented perpendicular to the rail faces to provide the multifinger contact between the rails and the armature.

Two of the most critical design parameters for a metallic armature are the contact force and the compliance. The magnitude of the contact force must be sufficient to maintain the contact drop at a low voltage in order to prevent rail damage caused by arcing. The greater the armature current density, the greater the contact force required for a low resistance current junction. The highest contact force achievable is limited by the allowable stress levels in the armature materials.

To maintain steady contact force, the armature must have sufficient compliance to accommodate both its own wear and changes in the distance between the launcher rails. Therefore, the armature must first develop the required contact force and then maintain it during the launch.

According to the invention, an armature for conducting very large currents between a pair of electrically conductive parallel rails while being driven down the rails under the influence of the electromagnetic forces generated by the application of the very large current to the rails, comprises a plurality of conductive fibers to provide multiple conductor rail contact points and to conduct current between the rails. These conductors are attached to an insulating support member. Transposition of the conductive fibers reduces electrical skin effect. The fibers may be attached to the contact surfaces of a chevron to increase structural rigidity.

An electromagnetic launcher employing a multiple fiber armature in accordance with this invention includes a high current power supply which is connected to a pair of projectile launching rails. A multiple fiber armature is slidably disposed between these rails with the multiple conductive fibers providing a path for current between the rails.

DESCRIPTION OF THE PREFERRED EMBODIMENTS

Figure 1:
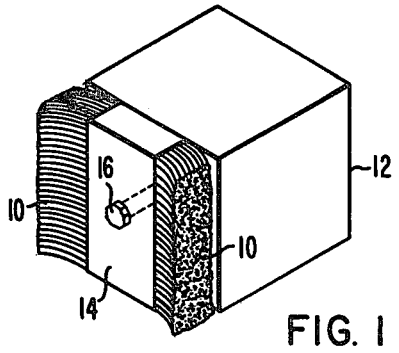
FIG. 1 is a perspective view of an armature in accordance with one embodiment of the present invention.

Referring to the drawings, FIG. 1 shows an armature in accordance with one embodiment of the present invention. A plurality of conducting fibers 10 are disposed along a surface of an insulating armature support member 12. This support member may be a projectile or sabot which slides between electrically conducting rails of the launcher. Fibers 10 have a length slightly longer than the width of support member 12 in order to provide electrical contact with the rails. During a launch, electromagnetic pressure is used to develop the necessary contact force. Prior to a launch, a preloading force is achieved by mechanically bending or compressing the armature between the rails. The length of fibers 10 in a particular launcher depends on the amount of force loading required.

Retaining band 14 holds the bundle of conducting fibers 10 together and bolt 16 serves as a means for attaching fibers 10 to support member 12. Conducting fiber bundles can be assembled by compressing the fibers in a die to obtain the desired cross section and fiber packing factor. Then fiber ends can be sanded flat to improve fiber to rail contact. Armatures of this type have been tested to current densities as high as 3 $GA/m^2$ and velocities as high as 489 m/sec. The tested samples utilized approximately 2500 strands of copper wire, 0.13 mm in diameter, with a length of approximately 13.21 mm. These wires were held in place by a metal retaining band which was attached by means of a bolt to a lexan projectile having a 12.7 mm width. The complete projectile and armature package had a mass of 7.01 grams.

Figure 2:
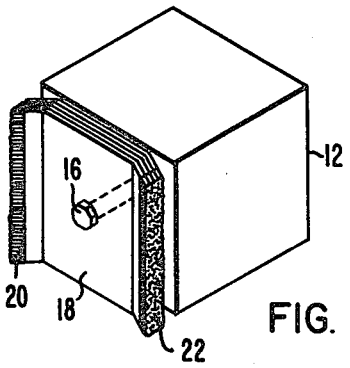
FIG. 2 is a perspective view of an armature in accordance with an alternative embodiment of the present invention.

FIG. 2 shows an armature in accordance with a second embodiment of this invention. Chevron plates 18 are stacked and attached by bolt 16 to insulating support member 12. Each chevron plate has two contact surfaces 20 which would provide electrical contact with the launcher rails in a conventional chevron armature. However in this embodiment, multiple conductive fibers 22 are attached to the chevron contact surfaces. These fibers are short compared to the fibers of FIG. 1. By shortening the fibers, mechanical bending moments and stresses have been decreased. The chevron plates of this design provide structural rigidity under loading while the conductive fibers provide a multi-contact interface with the launcher rails.

Figure 3:
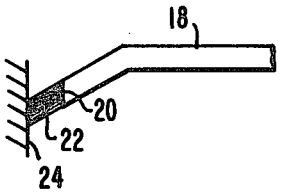
FIG. 3 is a partial top view of a chevron fiber assembly of the armature of FIG. 2.

FIG. 3 is a top view of a portion of a chevron plate 18 showing the location of conductive fibers 22 which are attached to chevron contact surface 20. These fibers provide a multi-contact interface with launcher rail 24.

Since current densities as high as several $GA/m^2$ occur in the armatures of electromagnetic launchers during a launch, electrical skin effect causes a non-uniform current distribution in the armatures. Transposition of insulated multiple conducting fibers in the armatures can overcome the skin effect and provide a uniform current distribution among the fiber-rail contact points. This can be easily accomplished through the use of multiple conductor litz wires for fabrication of the fiber bundles. Litz wires are comprised of multiple separately insulated conductors which are twisted or woven together so that each conductor tends to take all possible positions in the cross section of the entire conductor. Litz wires provide for a more uniform current distribution by equalizing the flux per unit length surrounding each wire strand. Suppliers of litz wire include New England Electric Wire Corporation, Lisbon, New Hampshire and Kerrigan Lewis Manufacturing Company, 4421 West Rice Street, Chicago, Ill. 60651. Partial or completely transposed litz wire is available.

Because of the high compliance of multi-fiber armatures, tolerances are less critical than with conventional multi-plate designs. This greatly simplifies fabrication and minimizes variation in projectile performance from shot to shot. The combination of high compliance and a large number of contact points provides for a smooth sliding action of the armature in the launcher rails and greatly reduces arc erosion of the rail surfaces. This is a significant advantage over metal plate armature types, especially in launcher systems where rail replacement after each shot is unacceptable, such as a submarine torpedo electromagnetic launcher.

Armatures for use in electromagnetic launchers are generally not considered to be part of the payload. Therefore it is desirable to minimize armature mass while at the same time providing for efficient current transfer between the launcher rails. Mechanically, contact force should be minimized to minimize friction which can contribute to rail surface damage. The use of multiple conductive fibers in an armature assembly provides multiple armature to rail contact points to enhance current transfer. If one of the fibers fails, a sufficient number of contact points remain so that the effects of redistributing the current are not catastrophic. The fibers also have sufficient compliance to minimize contact force while maintaining efficient electrical contact even where the distance between launcher rails changes due to rail erosion.

Armatures comprising greater than 2000 copper fibers have been tested experimentally. Retaining band 14 of FIG. 1 can be increased in width, thereby decreasing the free length of fibers 10 and improving electrical contact during a launch. Alternatively a rigid backing plate having a shape similar to chevron plates 18 of FIG. 2 can be attached to the rear of retaining band 14 in FIG. 1 to improve the electrical contact between the fibers and the launcher rails.

It should be apparent to those skilled in the art that armature assemblies other than those shown in the drawings also fall within the scope of this invention. For example, several fiber bundles can be attached to a single insulating support member for use in launchers employing internal augmenting rails, thereby requiring multiple armature current paths.

Figure 4:
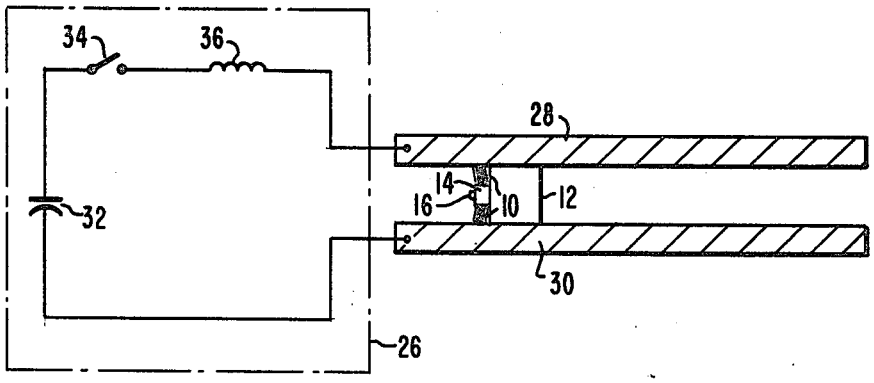
FIG. 4 is a schematic diagram of an electromagnetic launcher employing a multiple fiber armature in accordance with this invention.

FIG. 4 is a schematic diagram of an electromagnetic launcher employing a multiple fiber armature in accordance with this invention. High current power supply 26 is connected between two generally parallel conductive rails 28 and 30. The armature assembly of FIG. 1 is slidably disposed between rails 28 and 30. Prior to a launch, capacitor 32 is charged to a high energy level. Closing switch 34 allows current to flow through inductor 36, rail 28, conductive fibers 10, and rail 30. Electromagnetic forces resulting from this current flow, propel the armature assembly along the rails. Although power supply 26 is shown as a capacitor-inductor supply, other high current power supplies such as homopolar generatorinductor supplies may also be used.

Figure 5:
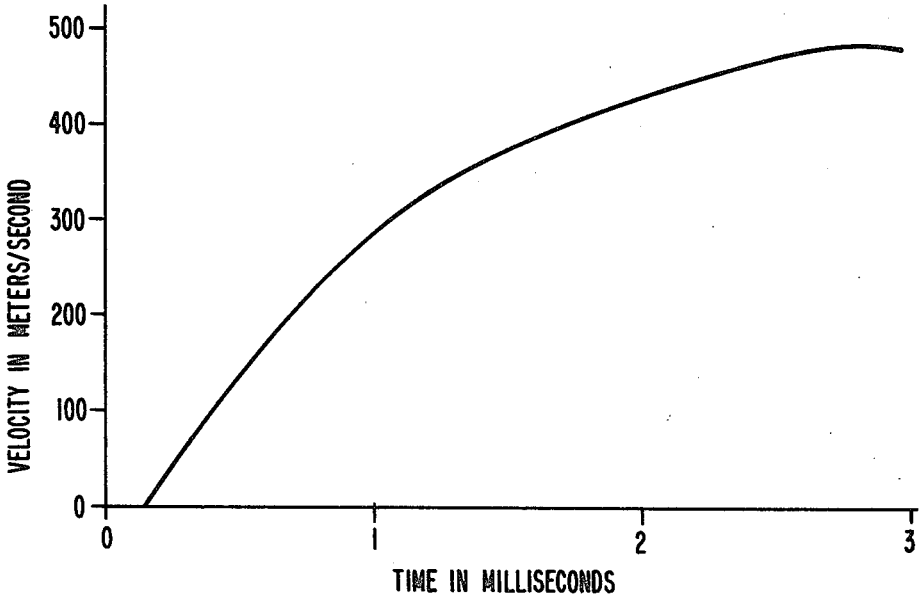
FIG. 5 is a plot of velocity vs. time for an experimental launch of a projectile employing an armature in accordance with this invention.

FIG. 5 is a plot of velocity vs. time for an experimental launch of a projectile employing a multifiber armature in accordance with this invention. This data was achieved with a parallel rail launcher having a capacitor-inductor pulse power supply. The capacitor bank had a total capacitance of 2880 $\mu F$ and was charged to 4800 volts. The bank was discharged through a 3 $\mu H$ inductor producing a 120 KA peak current, which was injected into the breech of a barrel having a length of one meter and a square bore measuring 12.7 mm on each side. The armature had a cross-sectional area of 40.35 $mm^2$ and a mass of 3.9 grams. Over 2000 copper fibers 0.13 mm in diameter were banded together to form the armature which was attached to a Lexan sabot by means of a small bolt. Each of the launcher rails had a rectangular cross-section measuring 4.76 mm by 19.05 mm. The final velocity of the projectile in the launch represented by FIG. 5 was 489 m/sec.

I claim:

1. An armature for conducting a very large dc current between two parallel, electrically conductive rails while being driven down the gap between the rails under the influence of the electromagnetic forces generated by the application of said very large dc current to the breech end of said rails, said armature comprising:

an insulating armature support member slidably disposed between said rails;

a plurality of conductive fibers, each having length greater than the width of said support member; and means for attaching said fibers to said support member, along a side of said support member facing said breech end of said rails wherein said conductive fibers conduct current densities on the order of a giga-amp per square meter while being driven along the rails.

2. An armature as recited in claim 1, further comprising a retaining band disposed around said conductive fibers.

3. An armature as recited in claim 1, further comprising a rigid backing plate attached to said conductive fibers.

4. An armature as recited in claim 3, wherein said conductive fibers number at least 2000.

5. An armature as recited in claim 1, wherein said conductive fibers are transposed.

6. An armature as recited in claim 1 or 5, wherein said conductive fibers are insulated litz wires.

7. An armature for conducting a very large dc current between two parallel, electrically conductive rails while being driven down the gap between the rails under the influence of the electromagnetic forces generated by the application of said very large dc current to the breech end of said rails, said armature comprising:

an insulating armature support member;

a chevron attached to said support member, said chevron having at least two contact surfaces; and a plurality of conductive fibers attached to said chevron contact surfaces wherein said conductive fibers conduct current densitites on the order of a giga-amp per square meter while being driven along the rails.

8. An armature as recited in claim 7, wherein said conductive fibers are made of copper.

9. An armature as recited in claim 8, wherein said conductive fibers number at least 2000.

10. An electromagnetic launcher comprising:

a first conductive rail;

a second conductive rail generally parallel to said first conductive rail;

a high current power supply connected to said first and second conductive rails; and an armature slidably disposed between said first and second conductive rails, for conducting current therebetween;

said armature including an insulating armature support member, a pluraltiy of conductive fibers each having a length greater than the width of said support member, and means for attaching said fibers to said support member wherein said conductive fibers conduct current densitites on the order of a giga-amp per square meter while being driven along the rails.

11. An electromagnetic launcher as recited in claim 10, further comprising:

insulation between said conductive fibers;

said conductive fibers being transposed.

12. An electromagnetic launcher as recited in claim 10, further comprising:

a retaining band disposed around said conductive fibers.

13. An electromagnetic launcher as recited in claim 10, further comprising a rigid backing plate attached to said conductive fibers.

14. An electromagnetic projectile launcher comprising:

a first conductive rail;

a second conductive rail generally parallel to said first conductive rail;

a high current power supply connected to said first and second conductive rails; and an armature slidably disposed between said first and second conductive rails, for conducting current therebetween;

said armature including an insulating armature support member, a chevron attached to said support member and having at least two contact surfaces, and a plurality of conductive fibers attached to said chevron contact surfaces wherein said conductive fibers conduct current densitites on the order of a giga-amp per square meter while being driven along the rails.

* * * * *